US005326312A

United States Patent [19]

Patroni

[11] Patent Number: 5,326,312

[45] Date of Patent: Jul. 5, 1994

[54] COIN/TOKEN DISPENSING UNIT

[75] Inventor: Anthony F. Patroni, 9005 Amherst Ave., Margate, N.J. 08402

[73] Assignees: Boardwalk Regency Corp., Atlantic City; Anthony Patroni, Margate, both of N.J.

[21] Appl. No.: 957,809

[22] Filed: Oct. 8, 1992

Related U.S. Application Data

[63] Continuation-in-part of Ser. No. 759,665, Sep. 13, 1991, abandoned.

[51] Int. Cl.[5] ..... G07D 1/00

[52] U.S. Cl. ..... 453/57; 221/188

[58] Field of Search ..... 453/13, 32, 33, 34, 453/49, 57; 221/174, 188, 203, 244, 265; 222/58, 166

[56] References Cited

U.S. PATENT DOCUMENTS

| | | | |
|---|---|---|---|
| Re. 28,557 | 9/1975 | Williams et al. . | |
| Re. 32,799 | 12/1988 | Abe . | |
| 765,741 | 7/1904 | Linindoll . | |
| 1,655,412 | 1/1928 | Donnellan . | |
| 1,664,310 | 3/1928 | Murray | 453/57 |
| 3,273,571 | 9/1966 | Seiden . | |
| 3,698,537 | 10/1972 | Black et al. . | |
| 3,783,885 | 1/1974 | Williams et al. | 453/33 |
| 3,788,334 | 1/1974 | Saraceno et al. . | |
| 3,942,544 | 3/1976 | Breitenstein et al. . | |
| 4,036,242 | 7/1977 | Breitenstein et al. . | |
| 4,059,122 | 11/1977 | Kinoshita | 453/33 X |
| 4,148,331 | 4/1979 | Nicolaus | 453/30 |
| 4,476,884 | 10/1984 | Gonzalez | 453/57 |
| 4,518,001 | 5/1985 | Branham . | |
| 4,574,824 | 3/1986 | Paulsen et al. . | |
| 4,589,433 | 5/1986 | Abe . | |
| 4,752,274 | 6/1988 | ABe | 453/32 |
| 4,798,558 | 1/1989 | Bellis | 453/32 |
| 5,000,718 | 3/1991 | Abe | 453/57 |
| 5,017,176 | 5/1991 | Swierczek | 453/49 |
| 5,064,404 | 11/1991 | Champion | 453/57 X |
| 5,066,262 | 11/1991 | Abe | 453/57 |
| 5,098,340 | 3/1992 | Abe . | |
| 5,114,381 | 5/1992 | Ueda et al. . | |
| 5,122,094 | 6/1992 | Abe | 453/57 |

FOREIGN PATENT DOCUMENTS

| | | | |
|---|---|---|---|
| 2513106 | 10/1976 | Fed. Rep. of Germany | 222/58 |
| 2142761A | 1/1985 | United Kingdom | 453/57 |

OTHER PUBLICATIONS

Baily Slot Machines, Dollar Hopper, Supplement Manual dated Fall 1976.

*Primary Examiner*—F. J. Bartuska
*Attorney, Agent, or Firm*—Dickstein, Shapiro & Morin

[57] ABSTRACT

A coin dispenser is disclosed which provides an agitator in the form of a rotatable plate having a surrounding ring which is used to agitate the coins so that the coins are constantly agitated as coins are being dispensed. A unique exit construction to minimize the dispensing of double coins and the jamming of coins at the exit location is also provided. A floating intermediate member is provided between the rotatable plate and reservoir which can move during dispenser operation to help prevent coin jamming at the reservoir/rotatable plate interface. The flow of coins to the rotatable plate may be controlled by a coin/token weight actuated pivoting reservoir.

39 Claims, 8 Drawing Sheets

FIG. 2
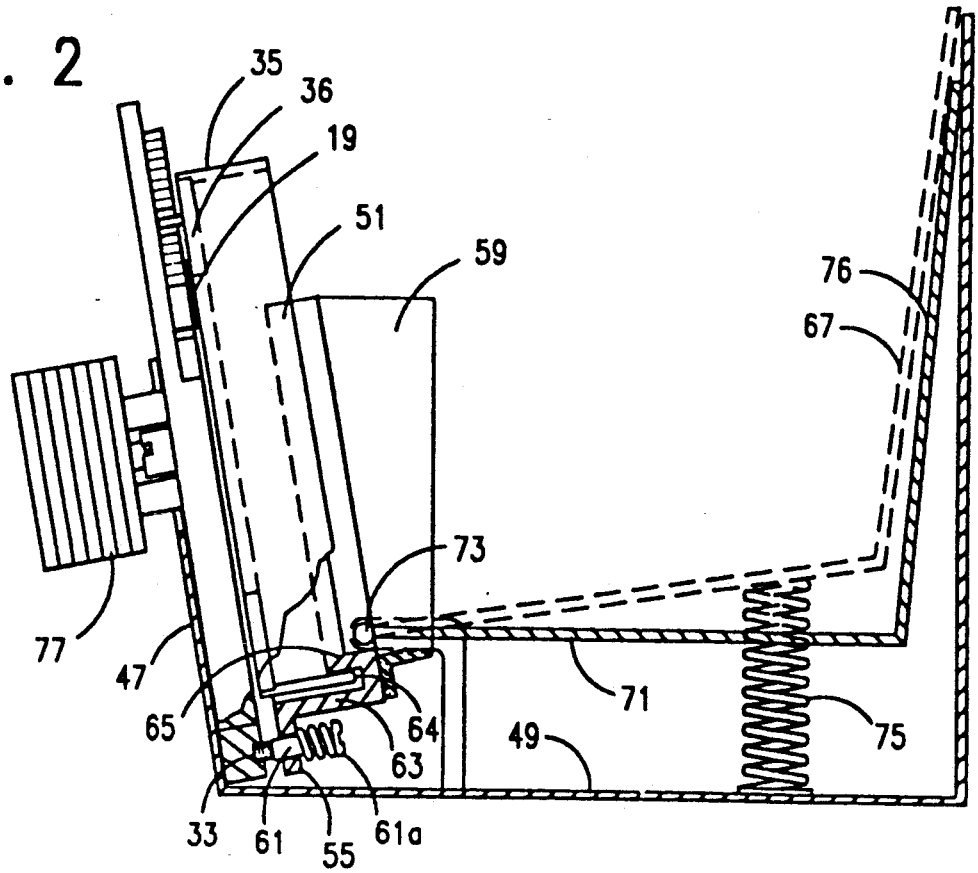
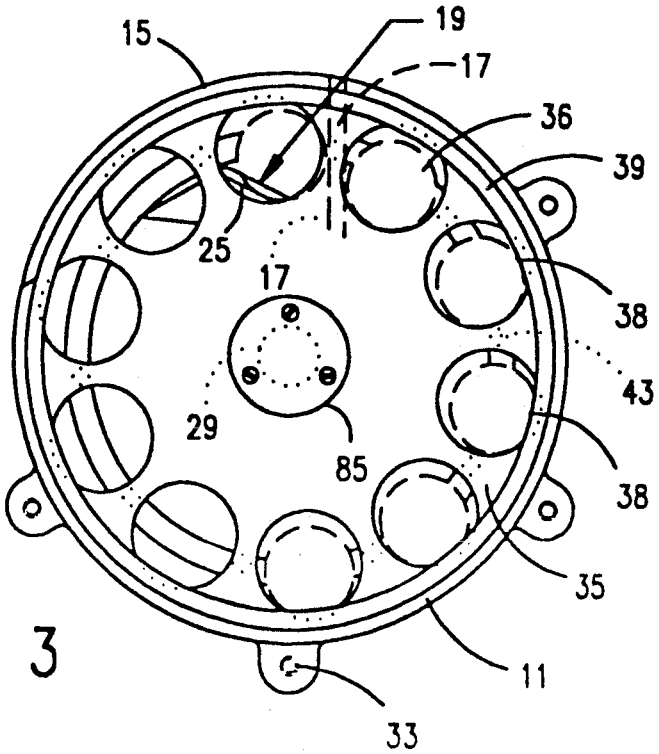
FIG. 3

FIG. 6
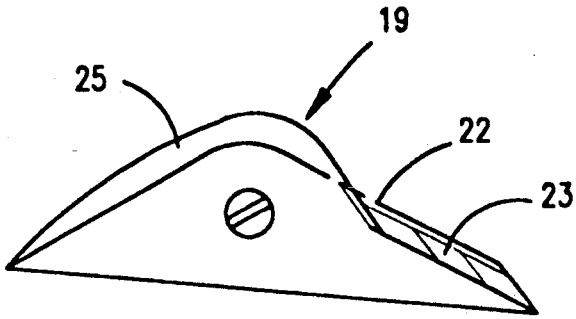
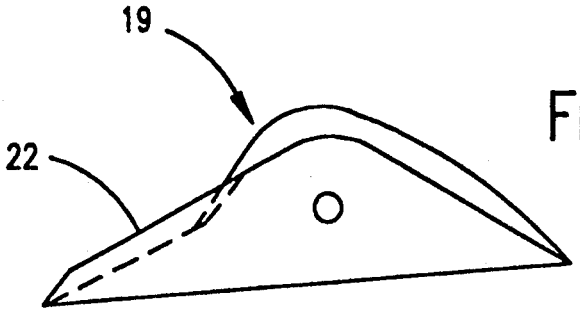
FIG. 7
FIG. 8
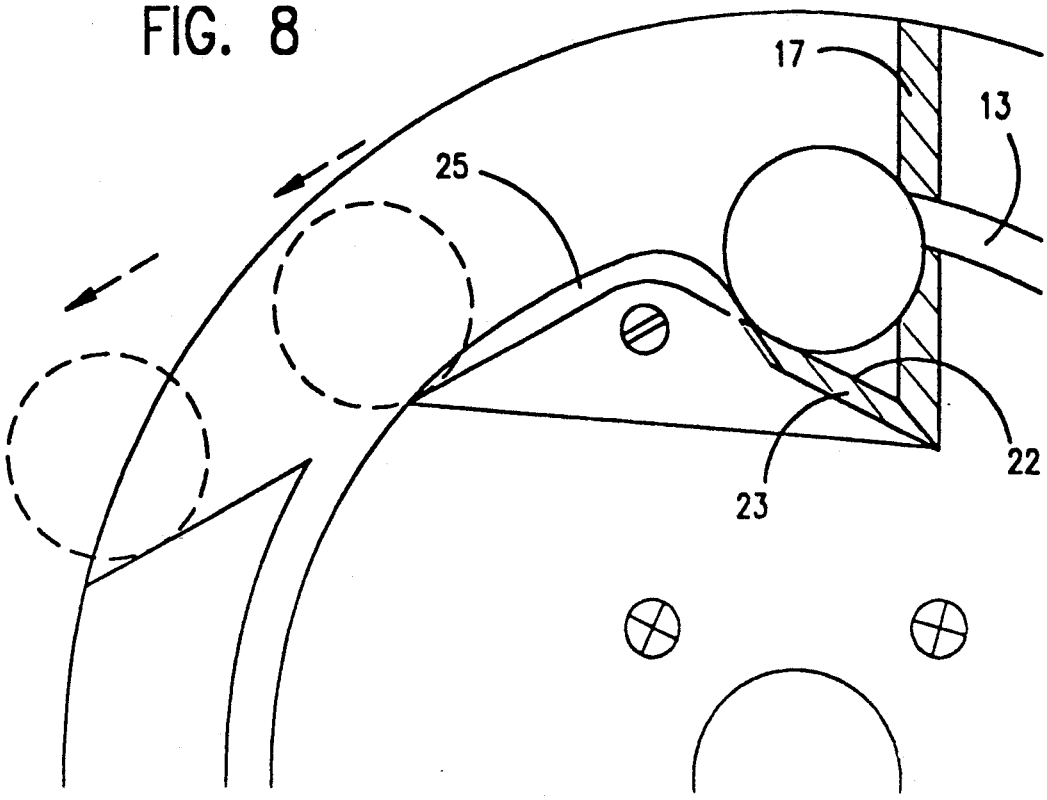

COIN/TOKEN DISPENSING UNIT

This is a continuation-in-part of pending U.S. patent application Ser. No. 07/759,665, filed Sep. 13, 1991, now abandoned, the entire disclosure of which is incorporated herein by reference.

BACKGROUND OF THE INVENTION

1. Field of the Invention

The present invention is directed to a coin/token dispensing unit which may be used with a slot machine for dispensing coins or tokens under certain predetermined payout conditions. More particularly, the present invention is directed to a coin/token dispensing unit which reduces the possibility of coin jamming during operation.

2. Brief Discussion of the Prior Art

Coin/token dispensing units are well known in the art and typically include internal coin agitators designed to keep the coins/tokens moving to thereby prevent jamming during a coin dispensing operation. One known coin agitator, for example, is found in U.S. Pat. No. 4,148,331 which discloses a star-shaped coin agitator. Although the star-shaped agitator has been widely used, a coin dispenser using it is subject to several problems including: coins do not receive enough agitation and no coins are pushed up along a coin moving plate, coins stack up and jam between the moving plate and a stationary reservoir and the agitator picks up coins as it stirs and throws extra coins into an exit which jams. The consequence of a coin/token jam is that the coin/token dispenser and associated equipment are taken out of service until an operator manually stirs the coins/tokens and/or otherwise frees the jammed condition.

SUMMARY AND OBJECTS OF THE INVENTION

One object of the present invention is to provide a coin/token dispensing unit which uses a rotatable plate having a peripheral sidewall ring for transporting coins/tokens to an exit slot. The rotatable plate both agitates the coins/tokens entering the dispensing unit from a reservoir and delivers them to an exit slot. The rotatable plate includes a plurality of coin/token moving holes located about its periphery with the sidewall ring overlapping a small portion of the periphery of the holes at the edge of the rotatable plate to guarantee that coins fall into the holes and to help hold the coins/tokens during transport. The rotatable plate construction provides significant coin agitation and delivery benefits resulting in reduced jamming of the coin/token dispenser.

Another object of the invention is to provide a coin/token dispenser which uses a self-adaptive pivoting reservoir to control the amount of coins/tokens flowing to the rotatable plate in accordance with the fill level of the reservoir, to reduce the possibility of coin/token jamming at the rotatable plate when the reservoir is filled.

Another object of the present invention is to provide a coin/token dispensing unit which provides a unique intermediate member positioned between the rotatable plate and a coin reservoir which directs coins/tokens from the reservoir to the rotatable plate. The intermediate member is mounted in a way which provides it with a certain amount of floating movement by virtue of which the coin/token dispenser is able to accommodate itself to various arrangements of the coins/tokens to further reduce the possibility of jamming at the interface of the reservoir and rotatable plate.

Another object of the invention is to provide a unique exit ramp construction for the exit slot of a coin/token dispenser which is also designed to reduce jamming and eliminate the possibility of erroneously dispensing two coins/tokens together.

The above and further objects, advantages and features of the invention will be more clearly understood from the following detailed description of the invention which is provided in connection with the accompanying drawings. In the ensuing description, the terms coin and token are used interchangeably, as both may be dispensed by the invention.

BRIEF DESCRIPTION OF THE DRAWINGS

FIG. 2 is a side view of the FIG. 1 embodiment;

FIG. 3 is a front view of a portion of the FIG. 1 embodiment;

FIG. 6 is a front view of a removable exit ramp;

FIG. 7 is a rear view of the exit ramp;

FIG. 8 is an enlarged front view of the exit ramp in use;

DETAILED DESCRIPTION OF PREFERRED EMBODIMENTS

Figure 1:
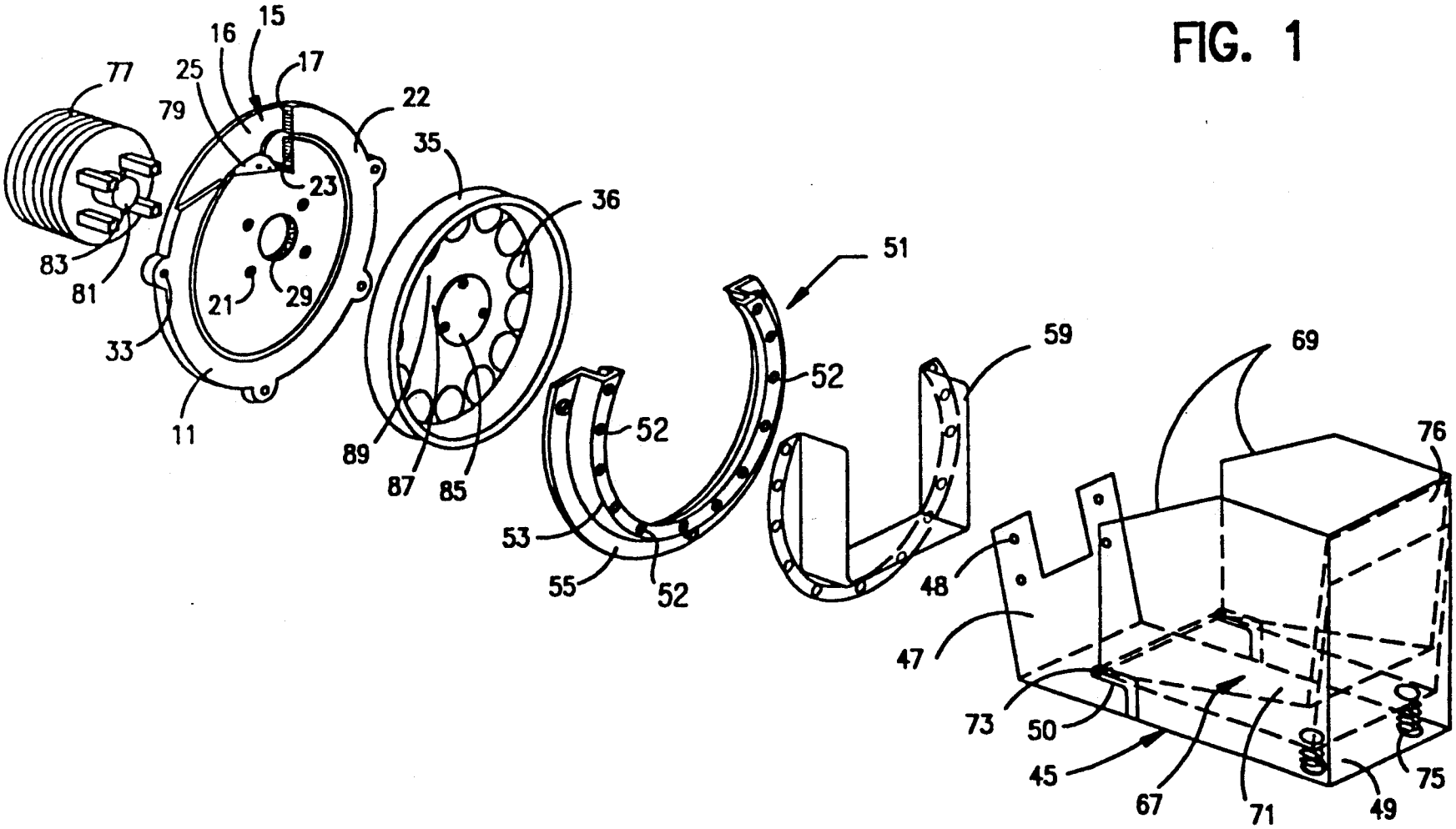
FIG. 1 is a perspective exploded view of a first embodiment of the present invention.

FIG. 1 illustrates in perspective exploded view the overall construction of the coin/token dispenser of the invention. A main support member 45 is provided which has a generally horizontally disposed floor 49, a front support wall 47, and a support element 50 for supporting a pivot rod 73. The main support member 45 is designed to rigidly support a motor 77, a stationary plate 11, and a rotatable plate 35 on wall 47. Wall 47 is inclined slightly, about 20°, from the vertical and thus, as shown in FIGS. 2 and 9, supports stationary and rotatable plates 11, 35 at a like incline.

As illustrated in FIGS. 1 and 2, the main support member 45 also supports a coin/token reservoir 67 having sidewalls 69, a floor 71, and a backwall 76. The reservoir 67 pivots about pivot rod 73 which is supported by support element 50 at its front end, and has one or more compression springs 75 provided between support floor 49 and reservoir floor 71 to bias the reservoir 67 counterclockwise about pivot rod 73. The force provided by compression spring(s) 75 is selected so that when the reservoir 67 is substantially filled with coins or tokens, their weight causes floor 71 of the reservoir to be substantially horizontal. However, as the coins are depleted from the reservoir, the compression springs 75 push the floor 71 counterclockwise about pivot 73 to provide a steeper angle and thereby ensure a weight-regulated feeding of remaining coins in the reservoir into the coin/token dispensing subassembly formed by stationary plate 11, rotatable plate 35, and intermediate U-shaped member 51. The self-adapting pivoting reservoir controls the flow of coins to the rotatable plate 35 to prevent it from becoming overloaded with coins/-tokens when reservoir 67 is filled near or to capacity.

Figure 9:
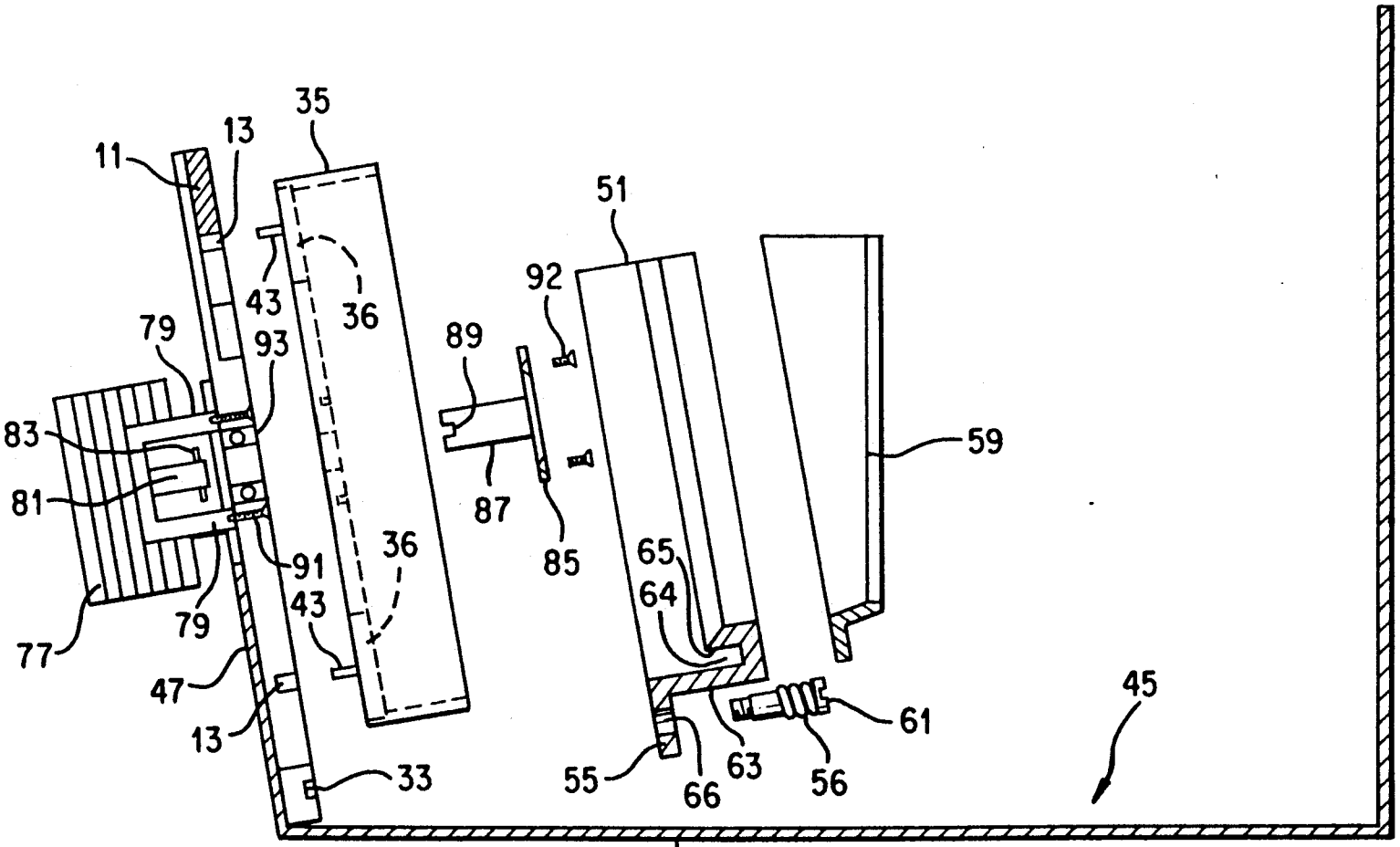
FIG. 9 is an exploded side view showing the interconnection of portions of the FIG. 1 embodiment.

The construction of the coin/token dispensing subassembly is illustrated in greater detail in FIGS. 1, 2 and 9. The front wall 47 of the main support 45 has motor 77 affixed to it by means of motor mounts 79. The motor mounts are in the form of legs extending from the motor to the front wall 47 of the main support 45. Wall 47 includes a plurality of holes 48 therein for receiving mounting bolts 91 (FIG. 9) which pass through matching holes 21 in stationary plate 11 to thereby securely mount both motor 77 and stationary plate 11 on opposite sides of the wall 47. A ball bearing 93 (FIG. 9) is also provided at an inside central boss of stationary plate 11 for receiving and rotatably supporting a shaft 87 from a drive coupler 85 which is affixed to a rotatable plate 35 by screws 92.

Rotatable plate 35 is used to both agitate and transport coins/tokens. It contains a central boss through which shaft 87 of drive coupler 85 can pass. The shaft 87 passes through and is press fitted to the inside race of ball bearing 93 and is supported for rotation by the ball bearing 93. Shaft 87 has a groove 89 which engages with a roll pin 83 of the motor shaft 81. Accordingly, rotation of motor shaft 81 causes rotation of drive coupler 85 and the rotatable plate 35 connected thereto.

An intermediary U-shaped member 51 is provided between the rotatable plate 35 and reservoir 67. This member, as illustrated in FIGS. 1, 2 and 9, has an outer sidewall 63 and an inner sidewall 65 which define a space 64 between them. The intermediary U-shaped member 51 is resiliently mounted to the stationary plate 11. To this end, the outer sidewall 63 terminates at a mounting flange 55 which contains a plurality of holes 66 through which a plurality of respective bolts 61 pass to engage with threaded bores 33 provided at stationary plate 11. A plurality of compression springs 56 are respectively mounted around the bolts 61 so that the intermediate U-shaped member 51 is resiliently mounted to and can move relative to the stationary member 11, as shown in FIGS. 2 and 9.

The inner sidewall 65 of the intermediate U-shaped member 51 project into the rotatable plate 35 providing an overlap joint with the ring sidewall 39. Stated otherwise, the ring sidewall 39 fits within the space 64 provided in the intermediate U-shaped member 51, as shown in FIG. 2. The intermediate U-shaped member 51 is also connected at one side by means of a resilient apron 59 to the walls of reservoir 67. This resilient apron may be formed of leather, a rubber or rubber-like material, or a flexible synthetic resin. The resilient apron is affixed at its one side to both the front side edges of the reservoir 67, that is, at the front edges of sidewalls 69 and the lower edge of floor 71, and, at its other side, to the outer periphery of the intermediate U-shaped member 51. The manner in which the resilient apron is affixed to members 51 and 67 may be by adhesives, or by riveting as exemplified in FIG. 1, or by any other method which will provide a solid connection between the resilient apron 59 and each of the reservoir 67 and intermediate U-shaped member 51.

Figure 5:
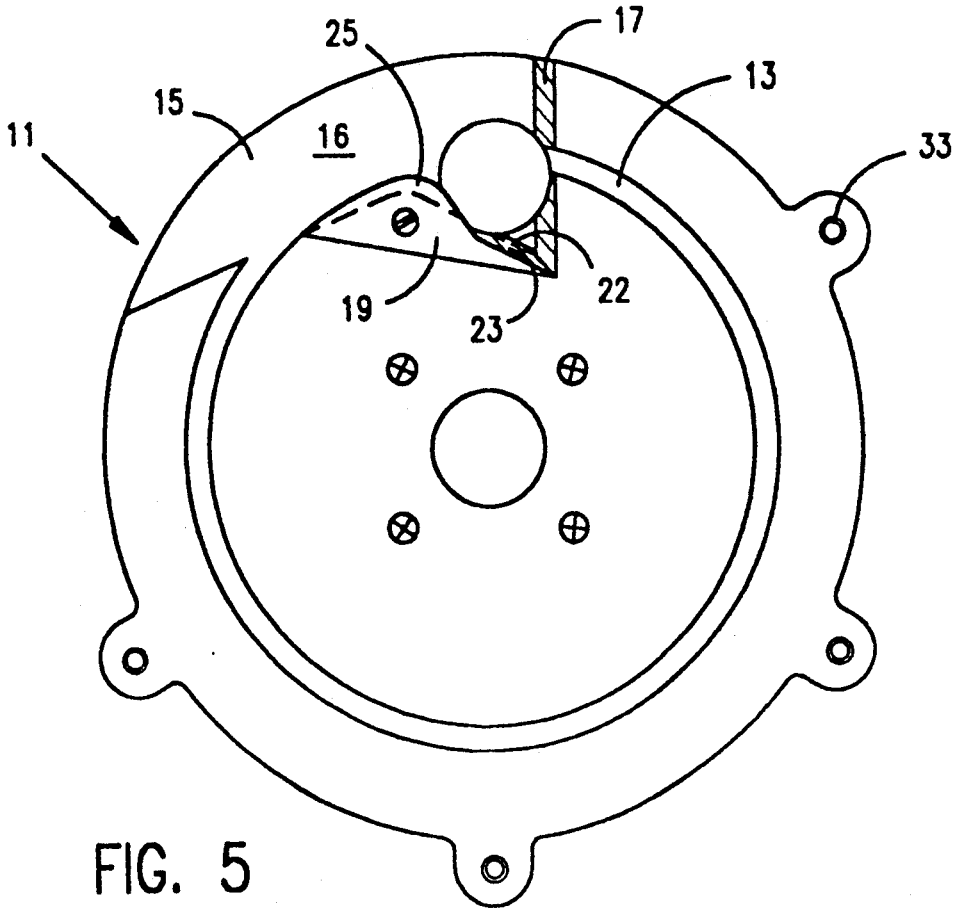
FIG. 5 is a front view of a stationary plate used in the FIG. 1 embodiment.

Stationary plate 11, as illustrated in FIG. 5, is generally a flat circular plate which has a cutout portion 15 at an upper peripheral surface thereof which forms a recessed area 16 from the remaining front surface portion of stationary plate 11. This recessed area 16 forms a coin exit area to which a coin is delivered by rotatable plate 35. The recessed area 16 is provided with a removable ramp 19 which provides a lower surface 22 (FIGS. 6, 7 and 8) along which the edge of a coin is guided for exit. A mounting hole 21 is provided in the ramp through which a bolt or screw can be inserted which engages with a threaded bore in the stationary plate 11 to secure the removable ramp to the stationary plate. The removable ramp 19 includes, as illustrated in FIGS. 1, 5, 6, 7 and 8, the upper surface 22 along which the edge of a coin delivered to the exit ramp may roll and bevel edge 23 which runs from a starting point of the ramp approximately one third of the length of the ramp and which is slanted in a direction towards the interior and bottom of rotatable plate 35, and a curb 25 at a side of ramp 19 closest to the reservoir 67. Curb 25 guides a lower edge of a coin/token as it passes through the recessed area 16 and exits the coin dispenser by riding to the peak of and then down ramp 19. Curb 25 prevents coins/tokens from side-slipping off ramp 19.

The stationary plate 11 also includes a bevel edge 17 which forms a transition area from the main surface of stationary plate 1 to the recessed area 16 provided by the cut out portion 15. This helps guide coins/tokens delivered to recessed area 16 by rotatable plate 35 through a smooth transition from the non-recessed portions of plate 11 to the recessed area 16.

Figure 4:
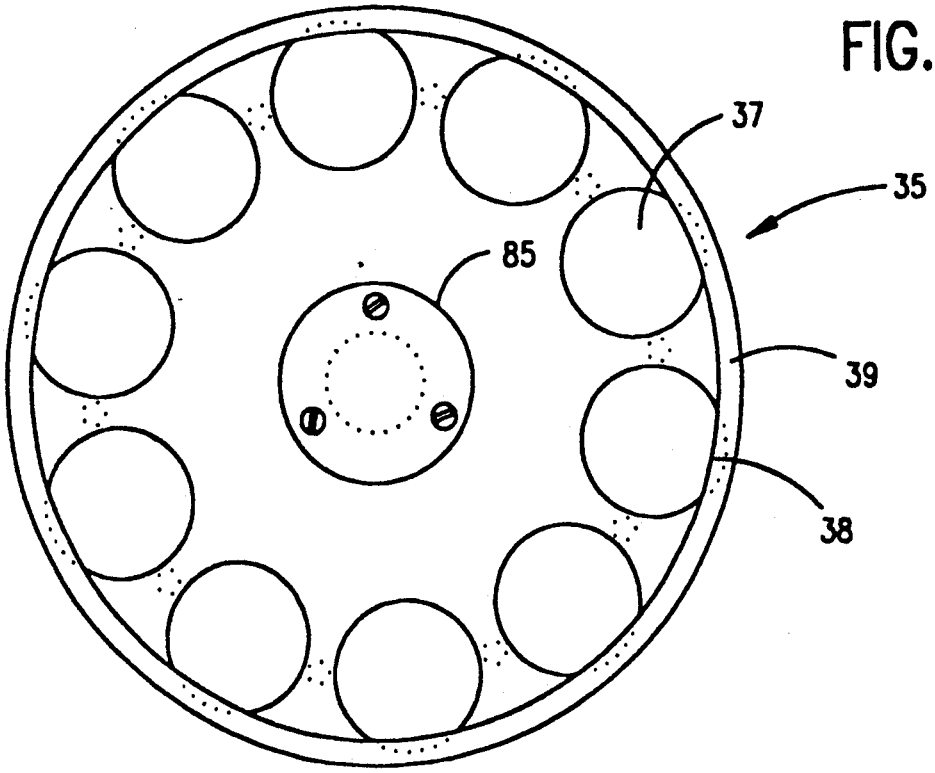
FIG. 4 is a front view of a rotatable plate used in the FIG. 1 embodiment.

Coins are delivered successively one-by-one to the recess area 16 by means of the coin transport holes 37 provided in the rotatable plate 35. As shown in FIG. 4, these holes 37 are provided near an outer periphery of the rotatable plate 35 and have a portion 38 of their outermost peripheral edge overlapped by the upstanding sidewall ring 39 which forms a part of rotatable plate 35. This overlap helps the coins to drop into holes 37. Holes 37 receive and transport coins/tokens, which are delivered to the rotatable plate 35 from the reservoir 67, upon rotation of motor 77, depositing those coins onto the surface of recess area 16. These coins are transported to and deposited on ramp 19 serially one-by-one as the coin moving holes 37 successively rotate counterclockwise from a six o'clock position shown in FIG. 3 up to and past the recessed area 16. As each coin/token is deposed on ramp 19, it is moved up the ramp and out the exit by being pushed by pins 43 provided on the backside of rotatable plate 35 and between the coin moving holes 37. Thus, the holes 37 deposit the coins onto the ramp 19, and the pins 43 drive the coins up the ramp and out the exit slot. Pins 43 ride in a groove 13 of stationary plate 11.

The sidewall ring 39 which rotates with rotatable plate 35 serves to stir and agitate the coins and by means of its overlap with holes 37, the coins/tokens are forced to drop into holes 37. As a consequence, all coins/tokens are agitated and transported when the rotatable plate 35 is rotated by the motor.

To help reduce the possibility of coin jamming, intermediate U-shaped member 51 is flexibly supported between rotating plate 35 and reservoir 67 in a "floating" manner. This is accomplished by the mounting of one side of the inner U-shaped member 51 to the stationary plate 11 through compression springs 66, and by the mounting of the other side of the intermediate U-shaped member 51 to the sidewall 69 and floor 71 of the reservoir through a resilient apron 59. Because it is flexibly mounted on both sides, the intermediate U-shaped member which guides coins/tokens from the reservoir 67 to the rotatable plate 35 is able to rock or flex during the agitation and transport of coins by the rotatable plate 35. The intermediate U-shaped member 51 has enough "rocking" and "flexing" ability to allow itself to move to accommodate various coin/token stacking conditions and prevent a coin/token jam.

The construction of the exit ramp 19 and associated recess area 16 of the stationary plate 11 further minimizes the possibility of coin jamming when a coin is deposited on the ramp 19 by the coin moving holes 37. The beveled portion 23 at the leading edge of ramp 19 prevents two coins from being on the exit ramp 19 at the same time. If a first coin is already on the exit ramp 19 when a second coin is delivered thereto by the next successive coin moving hole 37, the second coin will simply slide off the beveled portion 23 of the ramp back into the coin reservoir. In addition, the curb 25 which extends about two-thirds of the length of ramp 19, provides the narrow surface 22 along which a coin deposited at the exit may roll which is just wide enough to accommodate a single coin, thereby preventing the dispensing of double coins, as well as preventing side-slipping of a coin off ramp 19.

In use, reservoir 67 is filled with coins which causes the reservoir floor to assume a substantially horizontal position, as illustrated in FIG. 2. Coins from the reservoir enter the rotatable plate 35 through the intermediate U-shaped member 51. Since the reservoir 67 and intermediate U-shaped member 51 include upper open portions, should a jam occur it is relatively easy to manually stir the coins/tokens to alleviate a jamming condition. Coins enter at the bottom of rotatable plate 35. The rotatable plate 35 is inclined slightly, as shown in FIGS. 1 and 9, so that entering coins tend to assume, upon agitation, a generally parallel orientation relative to the bottom portion of rotatable plate 35, particularly with the assistance of agitation caused by the sidewall ring 39.

When a coin/token is to be dispensed, motor 77 is actuated to thereby rotate rotatable plate 35 counterclockwise as viewed in FIGS. 3–5 and 8. This both agitates coins/tokens at the lower portion of rotatable plate 35 and transports the coins/tokens received in the coin moving holes 37. The coins/tokens which enter the coin moving holes 37 are held therein with their faces against the stationary back plate 11 as they are transported by the holes 37 towards the recessed area 16 at the exit location. When a coin contained in the coin moving hole 37 reaches the recessed area 16 it is deposited therein by gravity due to the inclination of the stationary plate 11 and rotatable plate 35 from the vertical and with the guidance and assistance of beveled edge 17. The bottom level of the transport holes 37 is slightly higher than the level of exit ramp 19 when the coins/tokens are deposited on ramp 19 and a deposited coin/token falls slightly to surface 22 which is not beveled. If a second coin was deposited on the exit ramp, it would be deposited on the beveled edge 23 whereupon it would fall by gravity back into the lower portion of rotatable plate 35. After a coin is deposited on the surface 22 of ramp 19 by a hole 37, it is then further moved by an immediately following pin 43 provided on the backside of rotatable plate 35. The following pin 43 pushes the side edge of the coin deposited on ramp 19 up the ramp adjacent the curb 25 until the peak of the ramp is reached at which point the coin then falls on its own by gravity down the ramp and out the exit of the coin dispenser. The motor 77 will continue to operate until a coin sensor (not shown) which senses the number of coins exiting from ramp 19 matches with a predetermined number of coins to be dispensed. Once the proper number of coins is dispensed, the motor 77 is de-energized.

As the number of coins/tokens in reservoir 67 is depleted, the reservoir 67 pivots counterclockwise about pivot rod 73 to ensure that an adequate amount of coins reach the rotatable plate 35. In addition, when the reservoir 67 is filled with coins, the floor pivots clockwise about pivot rod 73 to occupy a substantially horizontal position. This thereby prevents the reservoir from overloading the rotatable plate 35 with coins when the reservoir is full. Thus, the spring bias provides the reservoir 67 with a self-regulated coin/token feed to the rotatable plate 35.

The invention provides for coin agitation by sidewall ring 39 at a location beneath the coins/tokens residing within rotatable plate 35 to ensure a more complete coin/token agitation. The pivoting reservoir prevents jamming by having too many coins forced against rotatable plate 35. In addition, the design of the exit ramp ensures that only one coin is dispensed at a time and helps prevent jamming at the coin exit. The flexible mounting of the intermediate member also assists in preventing coin/token jamming at the reservoir/rotatable plate interface.

Figure 10:
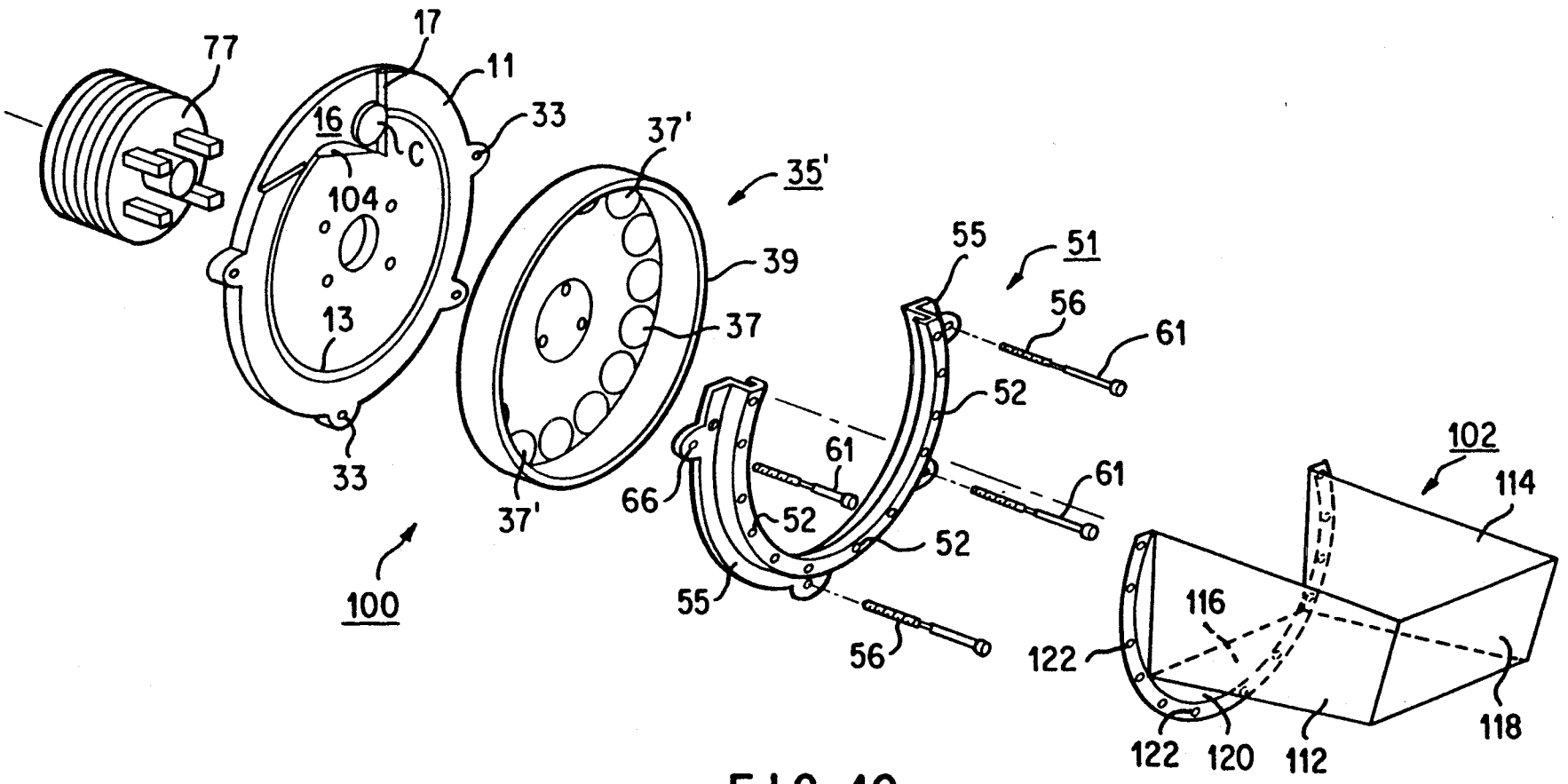
FIG. 10 is a perspective exploded view of a second embodiment of the present invention.

A second coin/token dispensing unit 100 constructed in accordance with a second preferred embodiment of the present invention is illustrated in FIG. 10. The dispensing unit 100 is identical in structure and operation to the dispensing unit illustrated in FIGS. 1–9, except as illustrated in the drawings and as described herein.

In particular, the dispensing unit 100 does not have a resilient apron 59. Instead, the dispensing unit 100 has a reservoir 102 that is fixedly connected directly to the intermediate U-shaped member 51. Another difference between the dispensing unit 100 and the dispensing unit illustrated in FIGS. 1–9 is that the dispensing unit 100 employs the ramp 104 illustrated in FIGS. 11–16 in place of the ramp 19 illustrated in FIGS. 6 and 7. Another difference is that, in the FIGS. 10–16 embodiment, the circumferential surfaces 106 (FIG. 11) of the openings 37' through the rotatable plate 35' are thick enough to support two coins/tokens. Still another difference is that, in the FIGS. 10–16 embodiment, the distance A between the leading edge of the top surface 108 of the ramp 104 and the center 110 of the rotatable plate 35' is greater than the distance B between the radially innermost portions of the openings 37' and the plate center 110.

As illustrated in FIG. 10, the reservoir 102 is formed of rigid side walls 112 and 114, a rigid downwardly angled bottom wall 116 and a rigid back wall 118. The reservoir 102 is open at its top and front. In operation, coins/tokens move by gravity downwardly along the bottom wall 116 toward the rotatable plate 35' as coins/tokens are moved upwardly by the openings 37' and dispensed out of the unit 100. When the reservoir 102 is empty, more coins/tokens can be added through the reservoir's open top.

The side walls 112, 114 and the bottom wall 116 are integrally connected to a generally U-shaped mounting flange 120. The mounting flange 120 (like the apron 59 illustrated in FIG. 1) has holes 122 aligned with the holes 52 in the U-shaped member 51. Thus, the reservoir 102 is fixedly connected to the U-shaped member 51 by rivets (not illustrated) which extend through the holes 122 and 52. As such, the reservoir 102 moves with the U-shaped member 51 when the mounting flange 55 is moved away from the stationary plate 11 against the bias of the compression springs 56 by coins/tokens jammed between the rotatable plate 35' and the mounting flange 55.

By connecting the reservoir 102 directly to the U-shaped member 51 as illustrated in FIG. 10, the total number of parts needed for the unit 100 can be advantageously reduced, making it more economical to produce the unit 100, and increasing the dispensing unit's reliability.

Figure 13:
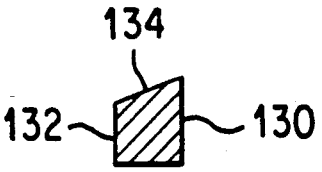
FIG. 13 is a cross-sectional view taken along the line 13—13 of FIG. 12.
Figure 14:
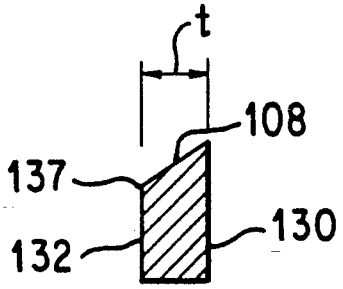
FIG. 14 is a cross-sectional view taken along the line 14—14 of FIG. 12.
Figure 15:
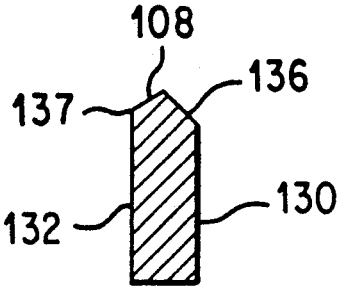
FIG. 15 is a cross-sectional view taken along the line 15—15 of FIG. 12.

The ramp 104 for the second preferred embodiment is illustrated in detail in FIGS. 12–15. The ramp 104 is formed of a single solid piece of metal or plastic and has a front face 130, a back face 132, a front surface 134, a ramp surface 108, and a smooth cylindrical scalloped surface 136. The front face 130 is adjacent to the rotatable ring 35' and the back face 132 is adjacent to the stationary plate 11. The faces 130 and 132 are inclined with respect to vertical, as in the FIGS. 1–9 embodiment. Further, the corner 137 (FIGS. 14 and 15) formed by the ramp surface 108 and the back face 132 is in contact with the stationary plate 11. The ramp 104 is removably connected to the stationary plate 11 by a suitable bolt 138. The top surfaces 134, 108 are each inclined toward the stationary plate 11 as best seen in FIGS. 13–15.

Figure 11:
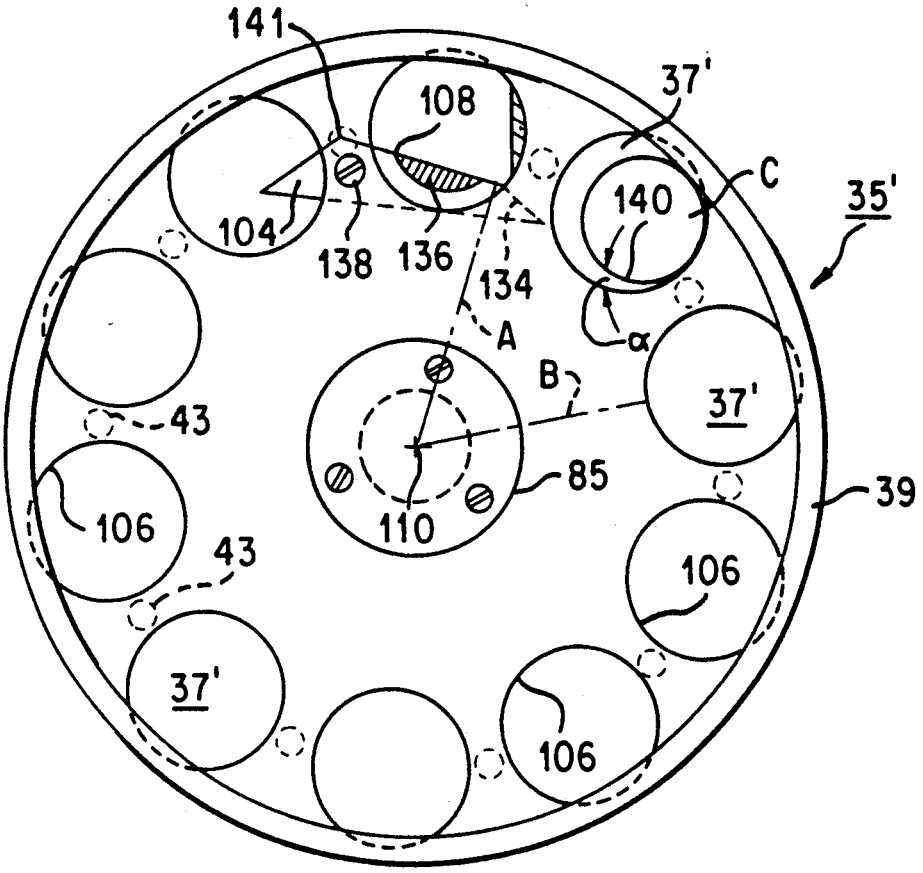
FIG. 11 is a front view of a portion of the FIG. 10 embodiment.
Figure 16:
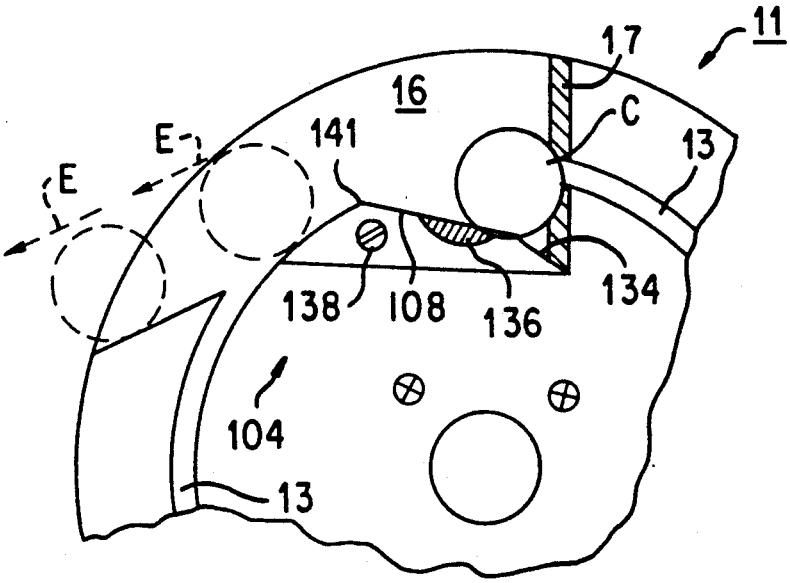
FIG. 16 is an enlarged front view of the exit ramp of FIG. 12 in use.
Figure 12:
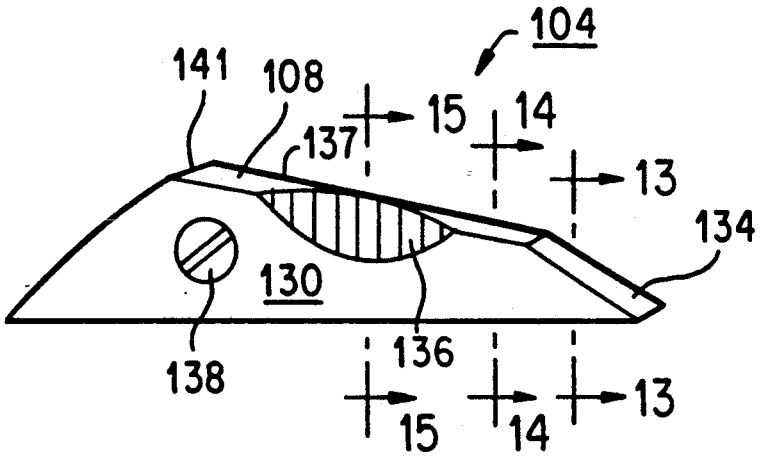
FIG. 12 is a perspective view of a removable exit ramp for the FIG. 10 embodiment.

In operation, at least one coin/token is transported toward the beveled edge 17 (FIGS. 11 and 16) by each opening 37' in a counterclockwise direction (as seen in FIGS. 11 and 16). When the plate 35' is rotating rapidly, inertial and centrifugal forces cause the coins/tokens to be displaced with respect to the openings 37'. This displacement is illustrated by a representative coin/token C in FIG. 11, with the coin/token C being displaced upwardly and to the right relative to the bottom most portion of the respective opening 37' by a distance d. The distance d increases as the coin/token approaches the ramp 104. Thus, the coins/tokens arrive at the ramp surface 108 with a bottom most edge 140 tangent to the ramp surface 108. With this arrangement, transfer of the coins/tokens through the openings 37' and onto the ramp surface 108 occurs smoothly, particularly when the plate 35' is rotating rapidly. When the plate 35 is not rotating rapidly (e.g., at the start or completion of a dispensing operation), the coins/tokens arrive at the ramp 104 at a lower position and come into contact with the front surface 134, and are moved upwardly onto the top surface 108 by the front surface 134.

As a coin/token moves past the beveled edge 17, the coin/token falls by gravity toward the stationary plate 11, i.e., toward the back surface of the recessed area 16 (FIG. 16). This motion toward the back surface is stabilized and encouraged by slanting the top surfaces 134 and 108 downwardly toward the stationary plate 11 as illustrated in FIGS. 13–15.

Almost all of the coins/tokens have the same standard thickness. But some of the coins/tokens have a sub-standard thickness that is slightly less than the standard thickness. The thickness t (FIG. 14) of the top surface 108 is approximately equal to the standard coin/token width. Thus, any second coin/token travelling with a standard width coin/token up to this point does not contact any portion of the ramp 104. Thus, the standard width coin/token is conveyed by itself over the uppermost portion 141 of the ramp 104, in the direction of the arrows E (FIG. 16).

When a sub-standard width coin/token is located within an opening 37' adjacent to the stationary plate 11, then any second coin/token traveling with the sub-standard width coin/token initially contacts the top surface 108, but then side-slips downwardly across the scalloped surface 136. The remaining sub-standard width coin/token remains in contact with the stationary plate 11 and passes over the upper edge of the scalloped surface 136 and is pushed by a pin 43 over the uppermost portion 141 of the ramp 104. The sub-standard width coin/token then exits the dispenser unit 100 by gravity in the direction of the arrows E.

In operation, there will be a second coin/token that is not pushed out through the exit in the direction of the arrows E for almost every coin/token that is pushed over the uppermost portion 141. This is because the circumferential surfaces 106 of the openings 37' are deep enough to support two coins/tokens. Making the rotatable plate 35' thick enough to support two coins/tokens within each opening 37' increases the payout rate. That is, permitting two coins/tokens to fit within each opening 37' reduces the likelihood of an opening 37' failing to contain at least one coin/token.

Although preferred embodiments of the invention have been described and illustrated, it should be apparent that many modifications can be made without departing from the spirit and scope of the invention. Accordingly, the invention is not limited by the foregoing description and drawings, but is only limited by the scope of the appended claims.

I claim:

1. A coin/token dispensing apparatus comprising:

a reservoir for receiving coins/tokens to be dispensed;

a coin/token transport mechanism for transporting a coin/token delivered from said reservoir to a coin/token exit, said transport mechanism comprising:

a stationary backplate and a rotatable coin/token driving plate mounted coaxially with and overlying said backplate, said driving plate receiving coins/tokens delivered from said reservoir and containing a plurality of coin/token engaging holes spaced substantially equidistant from a center of said driving plate and arranged about the periphery thereof;

an agitating ring connected to and surrounding said driving plate and extending from said driving plate in a direction away from said backing plate, said driving plate facing an interior of said reservoir to receive coins/tokens and guiding them into the holes of said driving plate, whereby the holes of said driving plate, when the latter is rotated, catch and transport coins to said exit while they are being supported by said stationary backplate;

means for rotating said driving plate to transport coins/tokens; and, means for supporting said backplate and driving plate at an incline from a vertical orientation so that coins are transported upwardly by the holes of said driving plate during its rotation, said exit being located at an upper portion of said backplate and being formed by a recess in said backplate, said recess being provided with an inclined exit ramp for receiving and guiding an edge of a coin/token, said ramp including a curb portion along a side of said ramp closest to said driving plate for preventing a coin transported on said ramp from side slipping off said ramp.

2. A dispensing apparatus as in claim 1, wherein said exit ramp has a beveled portion at the entry thereto for preventing two coins from being on the ramp at the same time, said bevel causing a coin/token deposited on said ramp when another coin/token is already thereon to fall into said reservoir.

3. A dispensing apparatus as in claim 1, wherein said ring overlies a radially outwardmost portion of each of said holes.

4. A dispensing apparatus as in claim 1, wherein a beginning of said exit ramp is positioned below the lower edge of a hole transporting a coin/token onto said exit ramp.

5. A dispensing apparatus as in claim 1, wherein said reservoir comprises:

a floor and sidewalls for holding coins/tokens, at least the floor of said reservoir being pivotal about a pivot axis to guide coins/tokens toward said driving plate, and means for biasing at least said floor upwardly so that as said reservoir is emptied of coins/tokens the degree of incline of said floor becomes steeper to direct coins/tokens toward said driving plate.

6. A dispensing apparatus as in claim 5, further comprising an intermediate member located between said driving plate and said reservoir, said intermediate member having a portion extending inside said agitating ring and guiding coins/tokens from said reservoir to said driving plate, said intermediate member being connected to said reservoir through a flexible member.

7. A dispensing apparatus as in claim 6, wherein said intermediate member is a U-shaped member having a U-shaped portion positioned inside said agitating ring, said intermediate member being resiliently mounted to said stationary plate, the resilient mounting of said intermediate ring to said stationary plate and the connection of said intermediate member to said flexible member permitting limited movement of said intermediate member during operation of said apparatus.

8. A dispensing apparatus as in claim 7, wherein said resilient mounting of said intermediate member to said stationary plate is provided by a plurality of spaced compression springs.

9. A dispensing apparatus as in claim 1, wherein said driving plate has on a rear surface thereof facing said stationary plate a plurality of projecting pins provided at respective locations between said holes, said pins driving coins deposited by said holes on said exit ramp up said ramp and out said exit.

10. A dispensing apparatus as in claim 9, wherein said backplate has an annular groove for receiving said projecting pins.

11. A dispensing apparatus as in claim 7, wherein said intermediate member has a portion which forms an overlap joint with said driving plate ring.

12. A dispensing apparatus as in claim 2, wherein said bevel portion extends to about one third of the length of said ramp.

13. A dispensing apparatus as in claim 1, wherein said curb portion extends along about two thirds of the length of said ramp.

14. A dispensing apparatus as in claim 1, wherein each of said reservoir and coin/token transport mechanism are supported by a common support member.

15. A dispensing apparatus as in claim 5, wherein said pivot axis is parallel to said stationary plate and said floor is substantially horizontal when said reservoir is fully loaded with coins/tokens.

16. A coin/token dispensing apparatus comprising:

a reservoir for receiving coins/tokens to be dispensed;

a coin/token transport mechanism for transporting a coin/token delivered from said reservoir to a coin/token exit, said transport mechanism comprising:

a rotatable coin/token driving plate, said driving plate receiving coins/tokens delivered from said reservoir and containing a plurality of coin/-token engaging areas spaced substantially equidistant from a center of said driving plate, said areas catching and transporting coins to said exit while they are being supported by said stationary backplate; and means for rotating said driving plate to transport coins/tokens;

said exit being provided with an inclined exit ramp for receiving and guiding an edge of a coin/token, said rotatable driving plate delivering a coin/token to said ramp, said ramp including a curb portion along a side of said ramp closest to said driving plate for preventing a coin transported on said ramp from side slipping off said ramp.

17. A dispensing apparatus as in claim 16, wherein said exit ramp further includes a beveled portion at the entry thereto for preventing two coins from being on the ramp at the same time, said bevel causing a coin/-token deposited on said ramp when another coin/token is already thereon to fall into said reservoir.

18. A dispensing apparatus as in claim 17, wherein said bevel portion extends to about one third of the length of said ramp.

19. A dispensing apparatus as in claim 16, wherein said curb portion extends along about two thirds of the length of said ramp.

20. A coin/token dispensing apparatus comprising:

a reservoir for receiving coins/tokens to be dispensed;

a coin/token transport mechanism for transporting a coin/token delivered from said reservoir to a coin/token exit, said transport mechanism comprising:

a rotatable coin/token driving plate, said driving plate receiving coins/tokens delivered from said reservoir and containing a plurality of coin/-token engaging areas spaced substantially equidistant from a center of said driving plate, said areas of said driving plate, when the latter is rotated, catching and transporting coins to said exit;

means for rotating said driving plate to transport coins/tokens; and an intermediate member located between said driving plate and said reservoir for guiding coins/-tokens from said reservoir to said driving plate, said intermediate member being resiliently mounted to a stationary support so as to be movable within a limited range relative to said driving plate to thereby accommodate different coin/token loading conditions existing between said reservoir and driving plate.

21. A dispensing apparatus as in claim 20, wherein said intermediate member is a U-shaped member resiliently mounted to a stationary backing plate associated with said driving plate, said intermediate member also being flexibly mounted to said reservoir through a flexible member, the resilient mounting of said intermediate member to said stationary plate and the flexible mounting of said intermediate member to said reservoir permitting movement of said intermediate member within said limited range during operation of said apparatus.

22. A dispensing apparatus as in claim 21, wherein said resilient support of said intermediate member to said stationary plate is provided by a plurality of spaced compression springs.

23. A dispensing apparatus as in claim 21, wherein said reservoir is a coin hopper and said flexible member is a flexible apron which interconnects said intermediate member and coin hopper.

24. A coin/token dispensing apparatus comprising:

a reservoir for receiving coins/tokens to be dispensed;

a coin/token transport mechanism for transporting said coins/tokens from said reservoir to a coin/-token exit, said transport mechanism including:

a backplate;

a rotatable coin/token driving plate for receiving said coins/tokens from said reservoir, said driving plate including a plurality of coin/token engaging areas for catching said coins/tokens and for transporting said coins/tokens to said coin/token exit while said coins/tokens are supported by said backplate; and a ramp member having a top ramp surface for receiving and guiding said coins/tokens, wherein said ramp member includes a scalloped surface for allowing some of said coins/tokens transported by said engaging areas to fall downwardly away from said exit, said scalloped surface having a front edge and a top edge, said scalloped surface being contiguous with said ramp surface along said top edge.

25. A dispensing apparatus as in claim 24, wherein, said ramp surface is inclined downwardly toward said backplate.

26. A dispensing apparatus as in claim 24, wherein said ramp member is removably attached to said backplate.

27. A dispensing apparatus as in claim 24, wherein said scalloped surface is substantially cylindrical.

28. A dispensing apparatus as in claim 24, wherein said engaging areas are deep enough to simultaneously transport two of said coins/tokens.

29. A dispensing apparatus as in claim 28, wherein said ramp surface has a thickness which is substantially equal to a standard thickness for said coins/tokens.

30. A dispensing apparatus as in claim 26, wherein said ramp surface is positioned relative to said engaging areas such that said coins/tokens are transported smoothly onto said ramp surface by said engaging areas.

31. A dispensing apparatus as in claim 26, wherein said ramp member includes a second surface for receiving and guiding said coins/tokens, said second surface being inclined downwardly with respect to said ramp surface.

32. A dispensing apparatus as in claim 25, further comprising a connecting member connected to said backplate, said connecting member being biased toward said backplate by springs and being movable away from said driving plate against the bias of said springs when a coin/token jam occurs within said dispensing apparatus, said reservoir being fixedly connected to said connecting member.

33. A dispensing apparatus as in claim 32, wherein said connecting member is generally U-shaped.

34. A dispensing apparatus as in claim 31, wherein said coin/token engaging areas are in the form of openings through said coin/token driving plate, said coin/-token driving plate having an axis of rotation, said ramp surface having a leading edge, said second surface (134) of said ramp member being contiguous with said ramp surface along said leading edge of said ramp surface, and wherein the distance (A) between said leading edge and said axis of rotation (110) is greater than the distance (B) between said openings and said axis of rotation.

35. A dispensing apparatus as in claim 24, wherein said backplate includes a groove (13), said driving plate including pins (43) for moving said coins/tokens across said ramp surface, said pins being located within said groove.

36. A coin/token dispensing apparatus comprising:

a pivotable reservoir for receiving coins/tokens to be dispensed;

a coin/token transport mechanism for transporting a coin/token delivered by said reservoir to a coin/-token exit, said transport mechanism comprising:

a rotatable coin/token driving plate, said driving plate receiving coins/tokens delivered from said reservoir and containing a plurality of coin/-token engaging areas spaced substantially equidistant from a center of said driving plate and arranged about the periphery thereof, said areas catching and transporting coins received from said reservoir and delivering them to an exit location;

means for rotating said driving plate to transport coins/tokens; and means for biasing said reservoir such that when the amount of coins/tokens in said reservoir diminishes a degree of incline of said reservoir increases; and said apparatus further comprising an intermediate member located between said driving plate and said reservoir for guiding coins/tokens from said reservoir to said driving plate, said intermediate member being resiliently mounted to a stationary support so as to be movable within a limited range relative to said driving plate to thereby accommodate different coin/token loading conditions existing between said reservoir and driving plate.

37. A dispensing apparatus as in claim 36, wherein said intermediate member is a U-shaped member resiliently mounted to a stationary backing plate associated with said driving plate, said intermediately member also being flexibly mounted to said reservoir through a flexible member, the resilient mounting of said intermediate member to said stationary plate and flexible mounting of said intermediate member to said reservoir permitting movement of said intermediate member within said limited range during operation of said apparatus.

38. A dispensing apparatus as in claim 37, wherein said resilient mounting of said intermediate member to said stationary plate includes a plurality of spaced compression springs.

39. A dispensing apparatus as in claim 37, wherein said reservoir is a coin hopper and said flexible member is a flexible apron which interconnects said intermediate member and coin hopper.

* * * * *